US011012792B2

(12) United States Patent
Elmedyb et al.

(10) Patent No.: US 11,012,792 B2
(45) Date of Patent: May 18, 2021

(54) METHOD OF OPERATING A HEARING AID SYSTEM AND A HEARING AID SYSTEM

(71) Applicant: WIDEX A/S, Lynge (DK)

(72) Inventors: Thomas Bo Elmedyb, Herlev (DK); Lars Dalskov Mosgaard, Copenhagen (DK); Jakob Nielsen, Copenhagen (DK); Georg Stiefenhofer, Hundested (DK); Adam Westermann, Copenhagen (DK); Michael Pihl, Copenhagen (DK)

(73) Assignee: WIDEX A/S, Lynge (DK)

( * ) Notice: Subject to any disclaimer, the term of this patent is extended or adjusted under 35 U.S.C. 154(b) by 0 days.

(21) Appl. No.: 16/481,912

(22) PCT Filed: Jan. 18, 2018

(86) PCT No.: PCT/EP2018/051200
§ 371 (c)(1),
(2) Date: Jul. 30, 2019

(87) PCT Pub. No.: WO2018/141559
PCT Pub. Date: Aug. 9, 2018

(65) Prior Publication Data

US 2020/0252734 A1 Aug. 6, 2020

(30) Foreign Application Priority Data

Jan. 31, 2017 (DK) ..... PA 2017 00063

(51) Int. Cl.
*H04R 25/00* (2006.01)

(52) U.S. Cl.
CPC ..... *H04R 25/505* (2013.01); *H04R 2225/55* (2013.01); *H04R 2460/01* (2013.01); *H04R 2460/11* (2013.01)

(58) Field of Classification Search
CPC ..... H04R 25/505; H04R 2460/11; H04R 2225/55; H04R 2460/01
See application file for complete search history.

(56) References Cited

U.S. PATENT DOCUMENTS 5,276,739 A * 1/1994 Krokstad ..... H04R 25/453 381/318
7,039,195 B1 * 5/2006 Svean ..... A61F 11/08 381/71.1
8,442,251 B2 * 5/2013 Jensen ..... H04R 25/453 381/318
8,532,320 B2 * 9/2013 Nordahn ..... H04R 25/70 381/321
2005/0232452 A1 10/2005 Armstrong et al.
2017/0127200 A1 * 5/2017 Kuriger ..... H04R 25/353

FOREIGN PATENT DOCUMENTS

WO 2016/112968 A1 7/2016

OTHER PUBLICATIONS

Written Opinion of the International Searching Authority of PCT/EP2018/051200 dated Apr. 6, 2018.
International Search Report of PCT/EP2018/051200 dated Apr. 6, 2018.

* cited by examiner

*Primary Examiner* — Tuan D Nguyen
(74) *Attorney, Agent, or Firm* — Sughrue Mion, PLLC

(57) ABSTRACT

A hearing aid system (500) with active noise cancelling and a method for operating such a hearing aid system.

10 Claims, 5 Drawing Sheets

METHOD OF OPERATING A HEARING AID SYSTEM AND A HEARING AID SYSTEM

The present invention relates to a method of operating a hearing aid system. The present invention also relates to a hearing aid system adapted to carry out said method.

BACKGROUND OF THE INVENTION

Generally a hearing aid system according to the invention is understood as meaning any device which provides an output signal that can be perceived as an acoustic signal by a user or contributes to providing such an output signal, and which has means which are customized to compensate for an individual hearing loss of the user or contribute to compensating for the hearing loss of the user. They are, in particular, hearing aids which can be worn on the body or by the ear, in particular on or in the ear, and which can be fully or partially implanted. However, some devices whose main aim is not to compensate for a hearing loss, may also be regarded as hearing aid systems, for example consumer electronic devices (televisions, hi-fi systems, mobile phones, MP3 players etc.) provided they have, however, measures for compensating for an individual hearing loss.

Within the present context a traditional hearing aid can be understood as a small, battery-powered, microelectronic device designed to be worn behind or in the human ear by a hearing-impaired user. Prior to use, the hearing aid is adjusted by a hearing aid fitter according to a prescription. The prescription is based on a hearing test, resulting in a so-called audiogram, of the performance of the hearing-impaired user's unaided hearing. The prescription is developed to reach a setting where the hearing aid will alleviate a hearing loss by amplifying sound at frequencies in those parts of the audible frequency range where the user suffers a hearing deficit. A hearing aid comprises one or more microphones, a battery, a microelectronic circuit comprising a signal processor, and an acoustic output transducer. The signal processor is preferably a digital signal processor. The hearing aid is enclosed in a casing suitable for fitting behind or in a human ear.

Within the present context a hearing aid system may comprise a single hearing aid (a so called monaural hearing aid system) or comprise two hearing aids, one for each ear of the hearing aid user (a so called binaural hearing aid system). Furthermore, the hearing aid system may comprise an external device, such as a smart phone having software applications adapted to interact with other devices of the hearing aid system. Thus within the present context the term "hearing aid system device" may denote a hearing aid or an external device.

The mechanical design has developed into a number of general categories. As the name suggests, Behind-The-Ear (BTE) hearing aids are worn behind the ear. To be more precise, an electronics unit comprising a housing containing the major electronics parts thereof is worn behind the ear. An earpiece for emitting sound to the hearing aid user is worn in the ear, e.g. in the concha or the ear canal. In a traditional BTE hearing aid, a sound tube is used to convey sound from the output transducer, which in hearing aid terminology is normally referred to as the receiver, located in the housing of the electronics unit and to the ear canal. In some modern types of hearing aids, a conducting member comprising electrical conductors conveys an electric signal from the housing and to a receiver placed in the earpiece in the ear. Such hearing aids are commonly referred to as Receiver-In-The-Ear (RITE) hearing aids. In a specific type of RITE hearing aids the receiver is placed inside the ear canal. This category is sometimes referred to as Receiver-In-Canal (RIC) hearing aids.

In-The-Ear (ITE) hearing aids are designed for arrangement in the ear, normally in the funnel-shaped outer part of the ear canal. In a specific type of ITE hearing aids the hearing aid is placed substantially inside the ear canal. This category is sometimes referred to as Completely-In-Canal (CIC) hearing aids. This type of hearing aid requires an especially compact design in order to allow it to be arranged in the ear canal, while accommodating the components necessary for operation of the hearing aid.

Hearing loss of a hearing impaired person is quite often frequency-dependent. This means that the hearing loss of the person varies depending on the frequency. Therefore, when compensating for hearing losses, it can be advantageous to utilize frequency-dependent amplification. Hearing aids therefore often provide to split an input sound signal received by an input transducer of the hearing aid, into various frequency intervals, also called frequency bands, which are independently processed. In this way, it is possible to adjust the input sound signal of each frequency band individually to account for the hearing loss in respective frequency bands.

In order to achieve optimum sound quality the hearing aid system needs to be adapted to suppress noise. This is, however, not always possible to do effectively by adjusting the frequency dependent gain provided by the hearing aid system.

External sound arrives at the eardrum of the hearing aid user through two main paths, directly through the vent and through the main signal processing of the in-situ hearing aid, which is adapted to alleviate an individual hearing deficit by applying a frequency dependent gain. The direct and the amplified sounds adds in an absolute manor, meaning that the total sound at the eardrum depends not only on the relative amplitudes of the two sound sources but also on the relative phase. E.g. if two harmonic signals are equal in amplitude but opposite in phase, the two signals will cancel each other completely. This is called destructive interference. On the other hand, if they are equal in phase they will interfere constructively and give a total signal which is 6 dB louder than each signal.

It has therefore been suggested to cancel out noise by adapting the hearing aid system to provide a cancelling signal that has the same magnitude and opposite phase of the noise and therefore cancels the noise in the ear canal through destructive interference.

U.S. Pat. No. 8,229,127B2 discloses a hearing aid system with an Active Noise Cancelling (ANC) unit that may be operated as an analogue feed-forward ANC systems, analogue feed-back ANC systems, digital feed-forward ANC systems, or digital feed-back ANC systems. However, the analogue systems appear to be preferred because they have a low delay which is an advantage for achieving a well-functioning ANC system. In an embodiment a digital feed-back cancellation unit is adapted to adjust the filter characteristics of the ANC filter.

U.S. Pat. No. 8,867,766B2 discloses a method of operating a hearing aid system, wherein an audible signal is provided by processing in first and second controlled signal processing paths and by transmission through an uncontrolled signal transmission path and wherein the processing in the second controlled signal processing path is adapted to provide a signal that compensate the signal provided by the uncontrolled signal transmission path and wherein only one sample rate is used in the second controlled path as opposed to several sample rates in the first controlled path, whereby the delay in the second controlled path may be kept low because the delay introduced as a consequence of changing a sample rate is avoided.

U.S. Pat. No. 9,319,814B2 discloses a hearing aid system with active occlusion control that is based on an ear canal microphone sensing a sound pressure in the residual ear canal space between the hearing aid system in the ear part and ear drum of the user and wherein the ear canal microphone signal is provided to an occlusion control compensator filter arranged in a feedback loop between the ear canal microphone and the hearing aid system receiver.

It is therefore a feature of the present invention to provide a method of operating a hearing aid system that provides improved active noise cancelling.

It is another feature of the present invention to provide a hearing aid system adapted to provide such a method of operating a hearing aid system.

SUMMARY OF THE INVENTION

The invention, in a first aspect, provides a hearing aid system comprising: a main signal path branch and an active noise cancelling branch, wherein the branches share an acoustical-electrical input transducer, an analog-digital converter, a digital-analog converter, an electrical-acoustical output transducer, a signal splitter configured to branch a signal in the main signal path into the active noise cancelling branch and a signal combiner to add the signals from the two branches, wherein the main signal branch further comprises a digital signal processor configured to apply a frequency dependent gain that is adapted to at least one of suppressing noise and alleviating a hearing deficit of an individual wearing the hearing aid system, and wherein the active noise cancelling branch comprises a group delay reducing element.

This provides a hearing aid system with improved means for operating a hearing aid system.

The invention, in a second aspect, provides a method of operating a hearing aid system comprising the steps of: obtaining a combined transfer function of at least one hearing aid component selected from a group comprising an acoustical-electrical input transducer, an analog-digital converter, a digital-analog converter and an electrical-acoustical output transducer, decomposing the combined transfer function into a first minimum phase transfer function and a first all-pass transfer function, providing a deconvolution filter transfer function as the inverse of the first minimum phase transfer function, processing a received sound in a main signal path of the hearing aid system in order to provide at least one of suppressing noise and alleviating a hearing deficit of an individual wearing the hearing aid system, processing the received sound in an active noise cancelling signal path in order to provide a low delay signal by filtering it with a filter having the deconvolution filter transfer function, combining the main signal path and the active noise cancelling signal path, by subtracting the signal provided by the active noise cancelling signal path from the signal provided by the main signal path and hereby providing a combined signal to the electrical-acoustical output transducer.

This provides an improved method of operating a hearing aid system with respect to cancelling noise.

The invention, in a third aspect, provides a non-transitory computer readable medium carrying instructions which, when executed by a computer, cause the following method to be performed: obtaining a combined transfer function of at least one audio component selected from a group comprising an acoustical-electrical input transducer, an analog-digital converter, a digital-analog converter and an electrical-acoustical output transducer, decomposing the combined transfer function into a first minimum phase transfer function and a first all-pass transfer function, providing a deconvolution filter transfer function as the inverse of the first minimum phase transfer function; processing a received sound in a main signal path in order to provide at least one of suppressing noise and alleviating a hearing deficit of an individual, processing the received sound in an active noise cancelling signal path in order to provide a low delay signal by filtering it with the deconvolution filter transfer function, combining the main signal path and the active noise cancelling signal path, by subtracting the signal provided by the active noise cancelling signal path from the signal provided by the main signal path and hereby providing a combined signal to the electrical-acoustical output transducer.

Further advantageous features appear from the dependent claims.

Still other features of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other embodiments, and its several details are capable of modification in various, obvious aspects all without departing from the invention. Accordingly, the drawings and descriptions will be regarded as illustrative in nature and not as restrictive. In the drawings.

DETAILED DESCRIPTION

Figure 1:
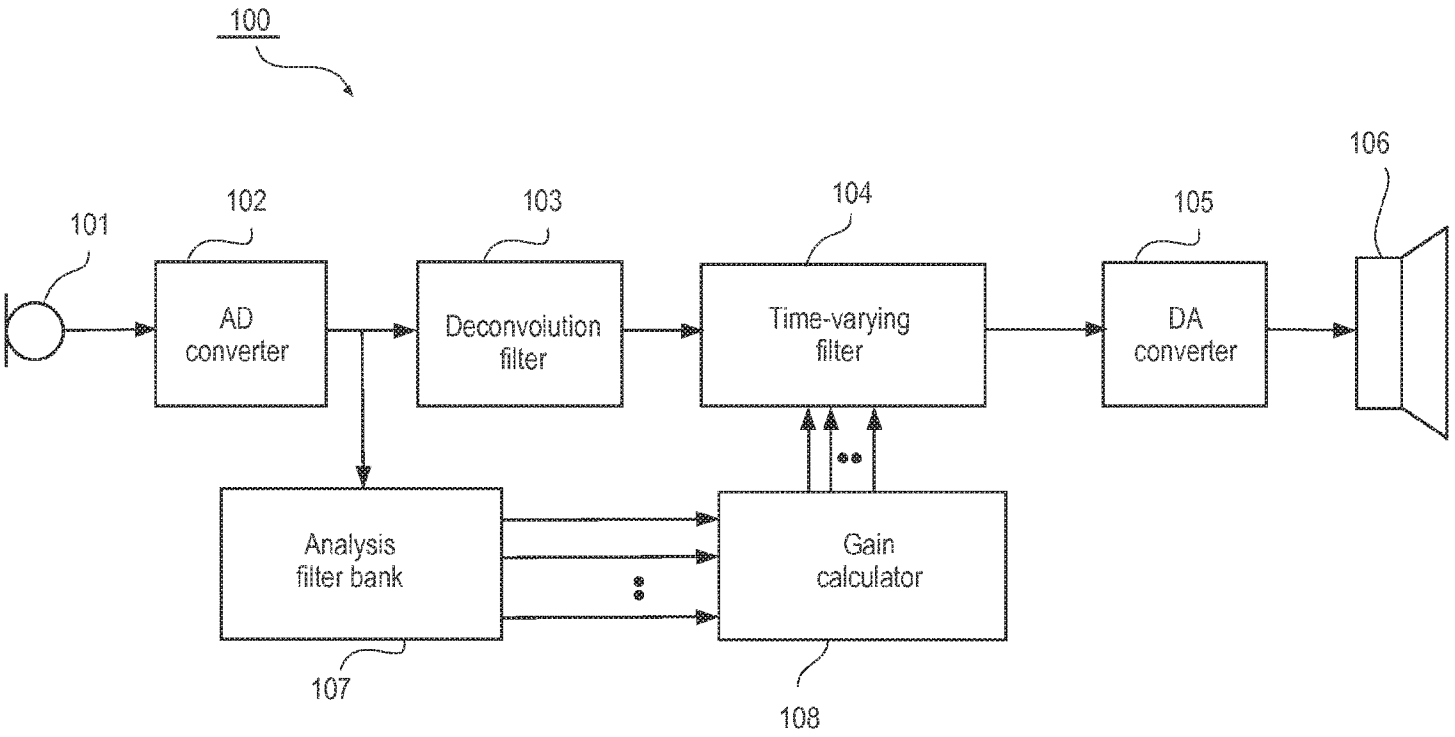
FIG. 1 illustrates highly schematically a hearing aid according to an embodiment of the invention.

In the present context the term signal processing is to be understood as any type of hearing aid system related signal processing that includes at least: noise reduction, speech enhancement and hearing compensation. Reference is first made to FIG. 1, which illustrates highly schematically a hearing aid 100 according to an embodiment of the invention.

In the present context the term "system" may be used interchangeably with the terms "filter", "transfer function" and "filter transfer function", e.g. when referring to minimum phase filters and all-pass filters.

The hearing aid 100 comprises an acoustical-electrical input transducer 101, i.e. a microphone, an analog-digital converter (ADC) 102, a deconvolution filter 103, a time-varying filter 104, a digital-analog converter (DAC) 105, an electro-acoustical output transducer, i.e. the hearing aid speaker 106, an analysis filter bank 107 and a gain calculator 108.

According to the embodiment of FIG. 1, the microphone 101 provides an analog input signal that is converted into a digital input signal by the analog-digital converter 102. However, in the following, the term digital input signal may be used interchangeably with the term input signal and the same is true for all other signals referred to in that they may or may not be specifically denoted as digital signals.

The digital input signal is branched, whereby the input signal, in a first branch, is provided to the deconvolution filter 103 and, in a second branch, provided to the analysis filter bank 107. The digital input signal, in the first branch, is hereby filtered by the deconvolution filter 103 and subsequently by the time-varying filter 104. The output from the time-varying filter is a digital signal that is processed to alleviate an individual hearing deficiency of a hearing aid user. This processed digital signal is subsequently provided to the digital-analog converter 105 and further on to the acoustical-electrical output transducer 106 for conversion of the signal into sound.

The digital input signal, in the second branch, is split into a multitude of frequency band signals by the analysis filter bank 107 and provided to the gain calculator 108 that derives a frequency dependent target gain, adapted for alleviating an individual hearing deficiency of a hearing aid user, and based hereon derives corresponding filter coefficients for the time-varying filter 104.

According to an embodiment, the frequency dependent and time-varying target gain is adapted to improve speech intelligibility or reduce noise or both in addition to being adapted to alleviating an individual hearing deficit. In further variations the time varying target gain is not adapted to alleviating an individual hearing deficit and instead directed only at reducing noise.

According to an embodiment the digital input signal is branched after processing in the deconvolution filter 103 as opposed to being branched before, and in a further variation the branching may be implemented somewhere between the time-varying filter 104 and the digital analog converter 105.

According to an embodiment, the analysis filter bank 107 is implemented in the time-domain and in another embodiment, the analysis filter bank is implemented in the frequency domain using e.g. Discrete Fourier Transformation.

According to an embodiment the digital-analog converter 105 is implemented as a sigma-delta converter, e.g. as disclosed in EP-B1-793897. However, in the following the terminology digital-analog converter is used independent of the chosen implementation.

The deconvolution filter 103 is a filter that is designed to deconvolute at least a part of the unavoidable convolution of the input signal from components such as the microphone 101, the ADC 102, the DAC 105 and the hearing aid speaker 106.

In the present context, these components may in the following be denoted static components as opposed to e.g. the time-varying filter 104 that obviously has a non-static transfer function.

According to an embodiment, the unavoidable convolution of the input signal from the static hearing aid components is determined based on obtaining the combined transfer function of the static hearing aid components. This may be done in a very simple manner by providing a test sound for the hearing aid and subsequently recording the corresponding sound provided by the hearing aid, while the time-varying filter is set to be transparent, and based hereof the combined transfer function can be derived from the ratio of the cross-correlation spectrum of the recorded sound and the test sound relative to the energy of the test sound. This may be done when manufacturing the hearing aid or as part of the initial hearing aid programming in which case the algorithms for determining the combined transfer function is implemented in the hearing aid programming software.

In the following, it will be assumed that the various transfer functions are determined in the z-domain and that the deconvolution filter 103 and the time-varying filter 104 subsequently are implemented in the time-domain. It is generally preferred to implement the filters in the time-domain in order to avoid the delay introduced by transforming the signal from the time domain and to the frequency domain and back again. However, in variations the deconvolution filter 103 and the time-varying filter 104 may be implemented in the frequency domain and in yet other variations other transformations than the z-domain may be used to determine the various transfer functions, but this is generally considered less attractive.

According to an embodiment, the determination of the combined transfer function of the static components may be carried out by software implemented in an external hearing aid system device, such as a so called app in a smart phone. Hereby, the determination may be carried out by the user with regular intervals, which may be advantageous because the combined transfer function may change due to e.g. ageing of the static components. According to another embodiment, the determination of the combined transfer function may be carried out while the hearing aid is positioned in a box that is also adapted for recharging a power source in the hearing aid.

It has been found that the combined transfer function may be represented by a stable pole-zero system that is not minimum phase, but can be decomposed into a minimum-phase system and an all-pass system that is not minimum phase.

A minimum-phase system is characterized in that it has a stable inverse, which means that all poles and zeros are within the unit circle, wherefrom it may be concluded that the inverse of a minimum-phase system is also minimum phase. Thus when decomposing the pole-zero system representing the combined transfer function, the resulting all-pass system will not be stable.

By designing the deconvolution filter 103 with a transfer function that is the inverse of the minimum-phase system of the combined transfer function of the hearing aid components it is possible to cancel out this minimum-phase system.

By cancelling the minimum phase system, the total delay in the hearing aid will be reduced which is advantageous in its own right and furthermore the cancelling will reduce frequency peaks in the combined amplitude response, which otherwise are an intrinsic part of most microphones and loudspeakers today.

Figure 2:
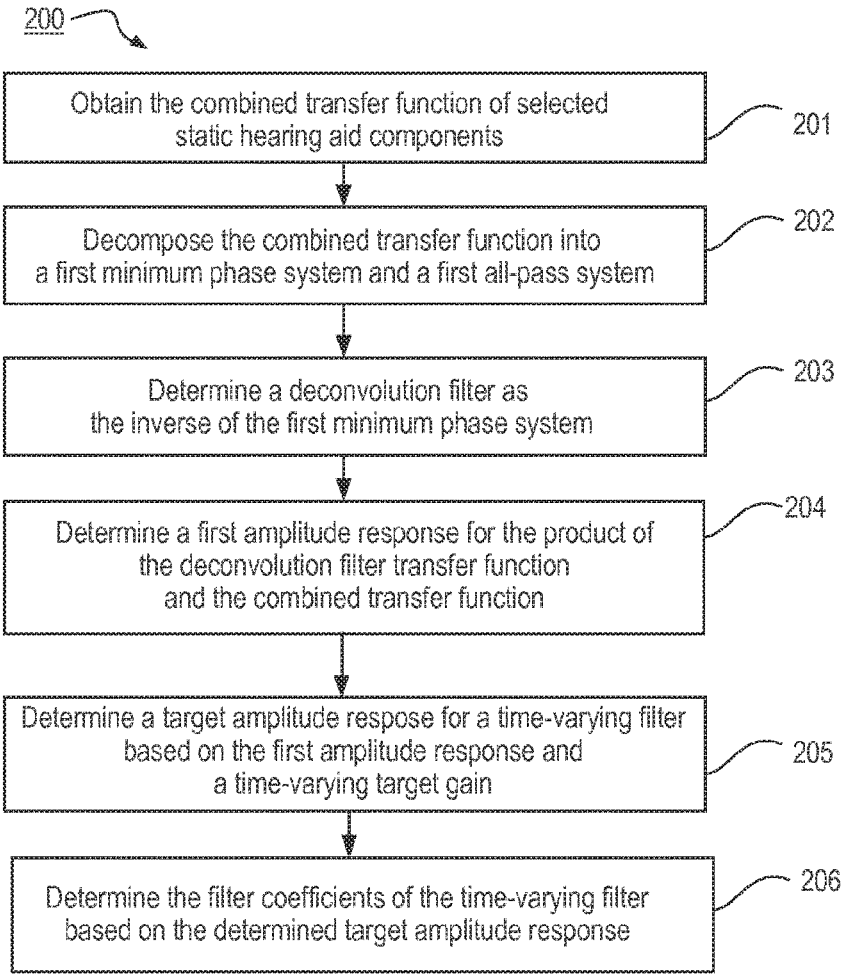
FIG. 2 illustrates highly schematically a method of operating a hearing aid according to an embodiment of the invention.

Reference is now made to FIG. 2, which illustrates highly schematically a method 200 of operating a hearing aid system according to an embodiment of the invention.

In a first step, 201, the combined transfer function of selected static hearing aid components is obtained.

In a second step, 202, the pole-zero system representing the obtained combined transfer function is decomposed into a first minimum phase system and a first all-pass system.

In a third step, 203, a deconvolution filter pole-zero system is determined as the inverse of the first minimum phase system and the filter coefficients for the deconvolution filter are derived.

In a fourth step, 204, a first amplitude response is determined, for the product of the deconvolution filter transfer function and the combined transfer function.

In a fifth step, 205, a target amplitude response for a time-varying filter is determined based on the first amplitude response and a time-varying target gain adapted to alleviate an individual hearing deficit.

In a sixth step, 206, the filter coefficients of the time-varying filter are derived based on the determined target amplitude response.

Hereby is provided a method of operating a hearing aid system with a very low time delay.

According to an embodiment, the derived filter coefficients for the deconvolution filter 103 and the time-varying filter 104 are optimized based on a cost function derived from perceptual criteria in order to achieve the best possible sound quality. In this way an optimum compromise between perceived sound quality and matching of the resulting amplitude response with the derived target amplitude response is achieved. In a variation of this embodiment, the optimum compromise is determined based on user interaction and in a further variation the user interaction is controlled by an interactive personalization scheme, wherein a user is prompted to select between different settings of the two filters and based on the user responses the interactive personalization scheme finds an optimized setting. Further details on one example of such an interactive personalization scheme may be found e.g. in WO-A1-2016004983.

A method of optimizing the filter coefficients based on user preference through an interactive personalization scheme is particularly attractive because it is difficult to predict in advance the cost function that best suits the individual users preferences.

Therefore effective optimization may be achieved using an interactive personalization scheme.

According to an additional variation, the user interaction comprises optimizing a speech intelligibility measure as a function of the selected filter coefficients.

According to an embodiment the time-varying filter 104 is implemented as a minimum phase filter. Generally any target amplitude response may be implemented as a minimum phase filter if a filter of sufficiently high order is available. If this is not the case a minimum phase filter, based on the available filter order, may be achieved by accepting a less precise matching to target amplitude response, e.g. by smoothing the frequency dependent target amplitude response curve. However, according to an alternative embodiment the time-varying filter 104 is not implemented as a minimum phase filter. In further variations the time-varying filter 104 may be implemented as a FIR filter or as an Infinite Impulse Response (IIR) filter or generally any type of filter.

Figure 3:
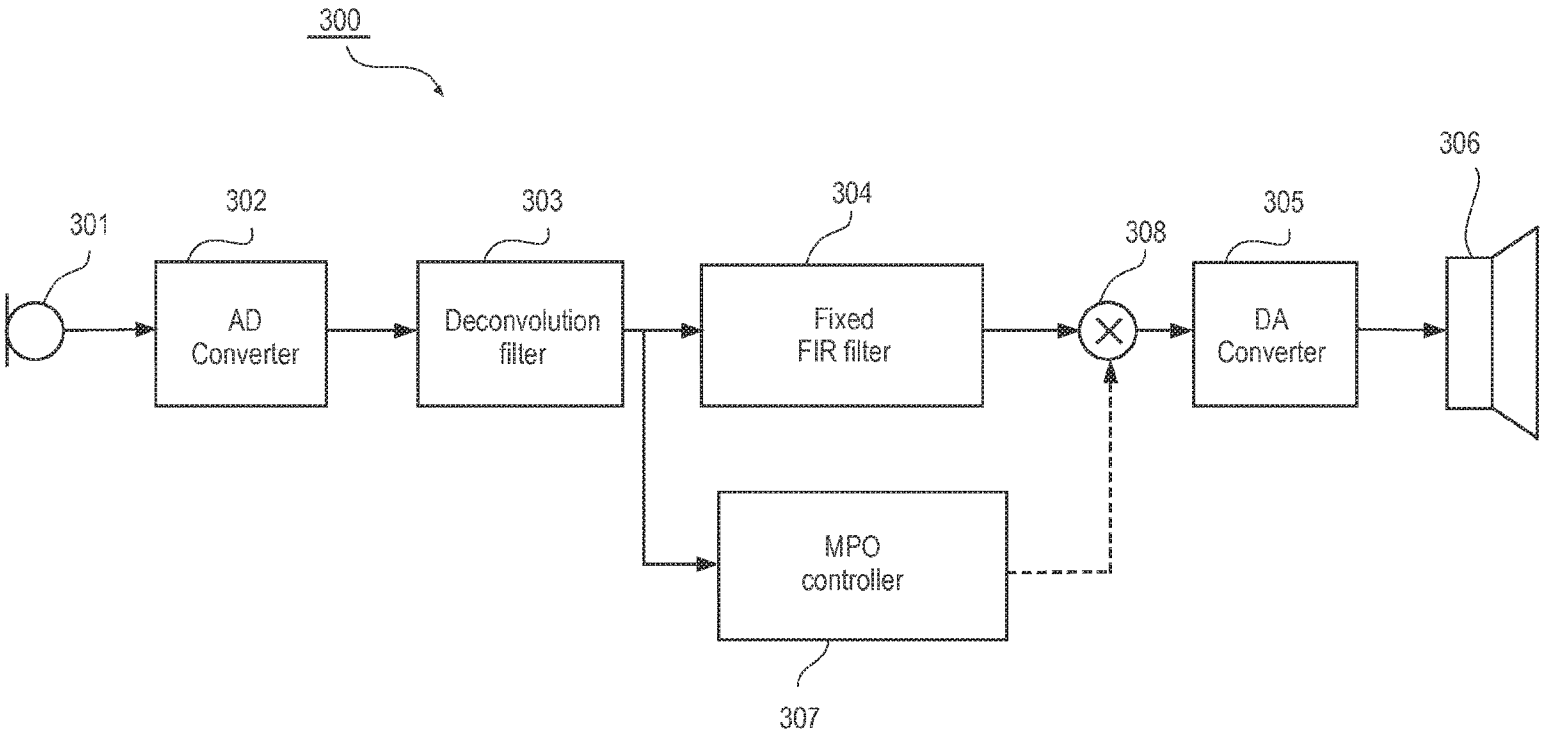
FIG. 3 illustrates highly schematically a hearing aid according to an embodiment of the invention.

Reference is now given to FIG. 3, which illustrates highly schematically a hearing aid system 300 according to an embodiment of the invention.

The hearing aid 300 comprises an acoustical-electrical input transducer 301, i.e. a microphone, an analog-digital converter (ADC) 302, a deconvolution filter 303, a fixed Finite Impulse Response (FIR) filter 304, a digital-analog converter (DAC) 305, an electro-acoustical output transducer, i.e. the hearing aid speaker 306, a Maximum Power Output (MPO) controller 307 and a gain multiplier 308.

According to the embodiment of FIG. 3 the microphone 301 provides an analog input signal that is converted into a digital input signal by the analog-digital converter 302. The digital input signal is provided to the deconvolution filter 303 and the resulting deconvoluted signal is branched, whereby the deconvoluted signal, in a first branch, is provided to the fixed FIR filter 304 that is adapted to compensate, or at least alleviate, an individual hearing deficiency of a hearing aid user and, in a second branch, is provided to the MPO controller 307 that estimates the power of the deconvoluted signal and based hereon calculates a negative gain to be applied to the fixed FIR filter output signal by the gain multiplier 308, in case this is required in order to avoid saturation of the digital-analog converter 305 or the hearing aid speaker 306 or that a too high sound pressure level is provided by the hearing aid speaker.

Thus the fixed FIR filter output signal is first provided to the gain multiplier 308 and subsequently provided to the digital-analog converter 305 and further on to the acoustical-electrical output transducer 306 for conversion of the signal into sound.

The deconvolution filter 303 according to this embodiment is adapted and operates as already described with reference to FIG. 1.

The hearing aid according to the embodiment of FIG. 3 is especially advantageous in that it provides a digital hearing aid with an extremely low delay and reasonable performance with respect to alleviating a hearing deficit of a hearing aid user. This is partly due to the fact that the hearing aid system 300 and its variations don't comprise any filter bank.

According to obvious variations the fixed FIR filter 304 may be implemented as e.g. an IIR filter or some other filter type.

According to a variation the functionality of the MPO controller 307 is extended to work as a broadband hearing aid compressor, i.e. controlling sound pressure level of the provided sound for all estimated input signal levels.

Figure 4:
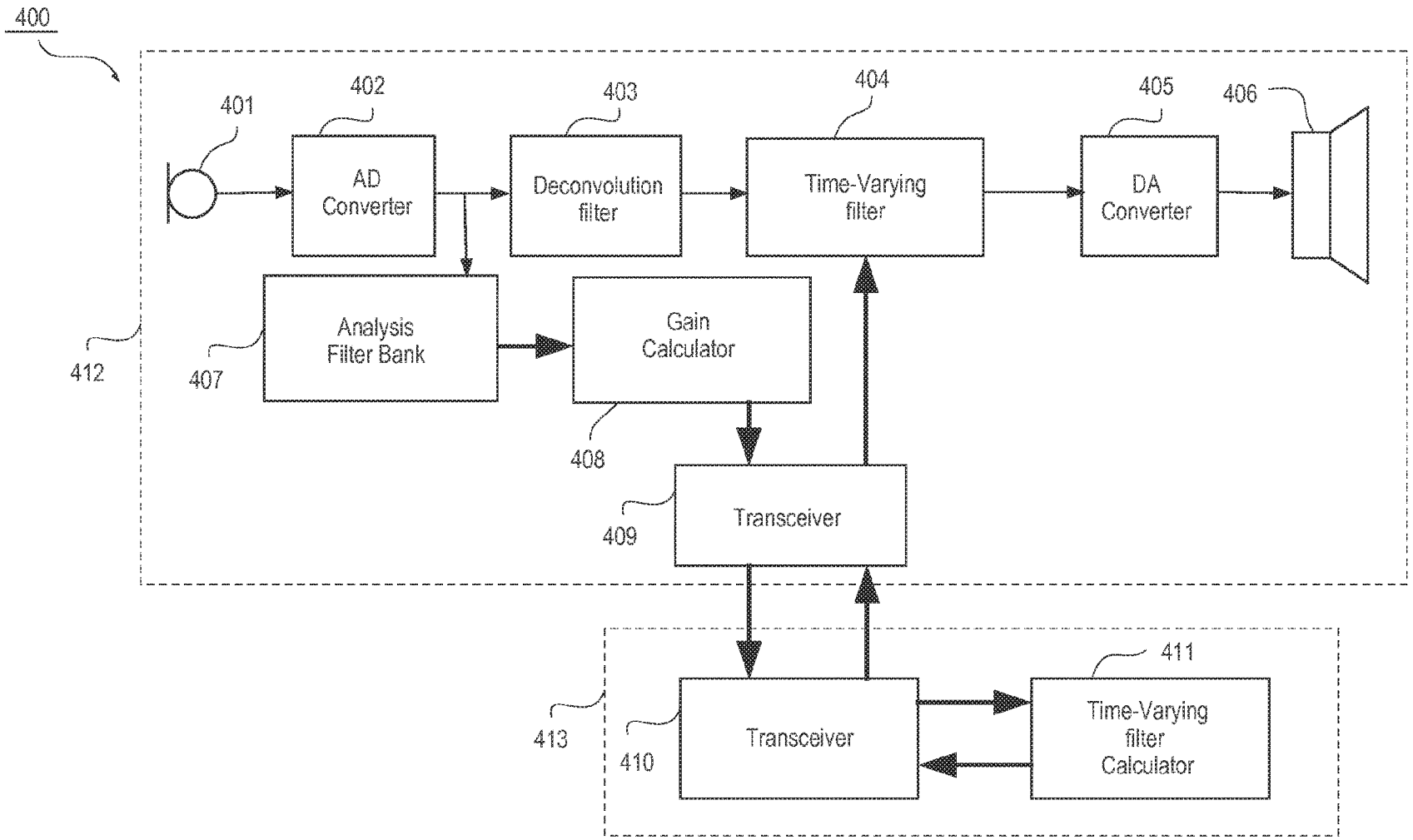
FIG. 4 illustrates highly schematically a hearing aid system according to an embodiment of the invention.

Reference is now made to FIG. 4, which illustrates highly schematically a hearing aid system 400 comprising a hearing aid 412 and an external device 413. The hearing aid 412 is similar to the hearing aid 100 according to the embodiment of FIG. 1 except in that the gain calculation required to control the time-varying filter 404 is distributed between the hearing aid 412 and the external device 413. In FIG. 4 some of the arrows are drawn in bold in order to illustrate a multitude of frequency band that are initially provided by the analysis filter bank 407. The gain calculator 408 is configured to provide a frequency dependent target amplitude response adapted to alleviate a hearing deficit of an individual hearing system user. The frequency dependent target amplitude response is provided to the hearing aid transceiver 409 that transmits, wired or wireless, the target amplitude response to the external device transceiver 410, wherefrom the target amplitude response is provided to the external device time-varying filter calculator 411, wherein corresponding filter coefficients are determined. Finally the determined filter coefficients are transmitted back to hearing aid 412, using the external device transceiver 410 and the hearing aid transceiver 409 and used to control the time-varying filter 404.

The FIG. 4 embodiment is especially advantageous because the partial distribution of the processing required to control the time-varying filter 404 allows use of the abundant processing resources available in most external devices, such as smart phones.

Additionally the embodiment is advantageous in that the hearing aid system delay is very low because only the analysis branch is affected by the delay introduced by the transmission back and forth between the hearing aid 412 and the external device 413—obviously the update of the of the time-varying filter will be delayed in response to the additional delay introduced in the analysis branch, but the inventors have found that to be of lesser importance.

The embodiment is furthermore advantageous in that very limited amounts of data need to be transmitted between the hearing aid 412 and the external device 413 because the frequency dependent target amplitude response is represented by a single gain value in a limited multitude of frequency bands, which according to the embodiment of FIG. 4 is 15, but in variations may be in the range between say 3 and 64, and because the determined filter coefficients correspondingly consists of a limited number of coefficients, which according to the embodiment of FIG. 4 is 64, but in variations may be in the range between 32 and 512 or more specifically in the range between 32 and 128.

In a variation the gain calculator 408 is accommodated in the external device 413 instead of in the hearing aid 412, which is particularly advantageous because it is expected that off-the-shelf digital signal processors for audio in the future will encompass the ability to provide the power spectrum or the frequency domain representation of the time domain input signal as a standard feature, while the calculation of the desired gain may not necessarily become a standard feature. In this variation the amount of data to be transmitted between the hearing aid 412 and the external device 413 may be somewhat larger, compared to the case where only data representing the frequency dependent target amplitude response are transmitted, in order to take advantage of the fact that off-the-shelf digital signal processors for audio in the near future are expected to provide a relatively high-resolution power spectrum i.e. a spectrum having say 512 channels (wherein channels may also be denoted frequency bins) or having between 32 and 4096 channels. As will be obvious for a person skilled in the art it only makes sense to discuss frequency resolution in terms of number of frequency channels under the assumption that the frequency range covered by the frequency channels is constant. Ultimately, the frequency resolution is only determined by the length in time of the analysis window. A typical choice of analysis window will be 20 milliseconds and at least the length of analysis window will be in the range between 1 millisecond and 60 milliseconds.

The various embodiments according to FIG. 4 are furthermore considered advantageous with respect to both battery consumption and required wireless bandwidth compared to the prior art of hearing aid systems having distributed processing because only the filter coefficients for the time-varying filter 404 need to be transmitted back to the hearing aid 412 from the external device 413.

In a further advantageous variation the wireless bandwidth required to transmit data from the hearing aid 412 and to the external device 413 is approximately the same bandwidth that is required for transmitting data the other way, which simplifies the implementation of the wireless transmission. According to a variation the data payload required to transmit a power spectrum is a factor of at least three larger than the data payload required to transmit a set of filter coefficients for the time-varying filter 404 but on the other hand the power spectrum only needs to be transmitted at least one third as often as the set of filter coefficients. According to a specific variation the power spectrum is calculated every say 200 milliseconds and comprises 512 frequency channels, which are represented by 16 bit, and consequently resulting in a required bandwidth of 41 kbps, whereas the say 64 filter coefficients, which also are represented by 16 bit needs to be updated every say 20 milliseconds and consequently resulting in a required bandwidth of 51 kbps. Furthermore it may be noted that wireless transmission of a digital input signal for a hearing aid system typically will require a larger bandwidth.

In a variation the time-varying filter calculator 411 is adapted to determine filter coefficients that provide a time-varying filter 404 that is minimum phase.

In a variation the frequency dependent target amplitude response may be determined in order to both suppress noise and alleviate a hearing deficit of an individual wearing the hearing aid system. Or in another variation the frequency dependent target amplitude response may be determined in order to only suppress noise.

In one variation of the FIG. 4 embodiments the deconvolution filter may be omitted.

In another variation the signal filtered in the deconvolution filter 403 is provided to the analysis filter bank instead of the digital input signal from the ADC 402, whereby the complexity of the gain calculation may be reduced.

In an embodiment, the time-varying filter 404 is configured to converge against a predetermined setting in response to a loss of wireless transmission between the hearing aid 412 and the external device 413. In a further variation the predetermined setting of the time-varying filter provides an amplitude response that is the opposite of the hearing loss of the individual wearing the hearing aid system. In a further variation a broadband compressor, corresponding to the MPO controller 307 and gain multiplier 308 disclosed with reference to FIG. 3 is additionally activated in response to the loss of wireless transmission.

Figure 5:
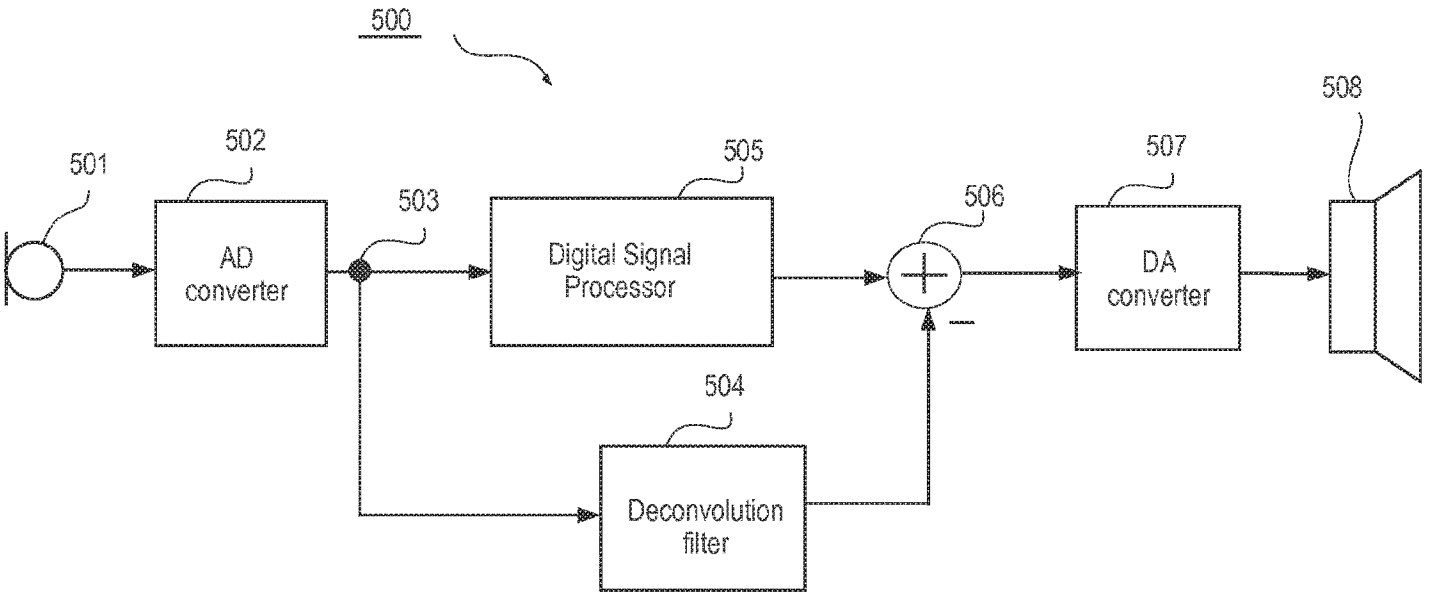
FIG. 5 illustrates highly schematically a hearing aid system according to an embodiment of the invention.

Reference is now made to FIG. 5, which illustrates highly schematically a hearing aid system 500 according to an embodiment of the invention.

The hearing aid system 500 comprises an acoustical-electrical input transducer 501, i.e. a microphone, an analog-digital converter (ADC) 502, a signal splitter 503, a deconvolution filter 504, a digital signal processor 505, a signal combiner 506, a digital-analog converter (DAC) 507 and an electro-acoustical output transducer, i.e. the hearing aid speaker 508.

The output from the ADC is provided to the signal splitter 503, whereby two parallel branches are formed, which in the following may be denoted the main signal branch and the active noise cancelling branch respectively. The active noise cancelling branch comprises—in addition to the components that are shared by the two branches, namely the microphone 501, the ADC 502, signal splitter 503, the signal combiner 506, the DAC 507 and the hearing aid speaker 508—the deconvolution filter 504 and is combined with the main signal branch through the signal combiner 506, wherein the signal provided from the deconvolution filter 504 (i.e. from the active noise cancelling branch) is subtracted from the signal from the digital signal processor 505 (i.e. from the main signal branch). The output from the signal combiner 506 is provided to the DAC 507 and then on to the hearing aid speaker 508. The main signal branch further comprises, inserted between the signal splitter 503 and the signal combiner 506 the digital signal processor 505 that is configured to apply a frequency dependent gain that is adapted to suppress noise or alleviate a hearing deficit of an individual wearing the hearing aid system or both.

As discussed with reference to the previous embodiments the deconvolution filter 504 has the effect of reducing the total group delay of a processing path by compensating delay introduced by other components of the processing path. In the present embodiment the deconvolution filter may therefore reduce the group delay introduced by components selected from a group comprising the acoustical-electrical input transducer 501, the analog-digital converter 502, the digital-analog converter 507 and the electrical-acoustical output transducer 508, for at least some frequency components.

The advantage of incorporating the active noise cancelling branch, according to the present invention, in a hearing aid system is that it allows active cancelling of sound that is transmitted past the hearing aid system and directly to the eardrum. In order to achieve effective active noise cancelling the amplitude of the directly transmitted sound needs to be comparable to the amplitude of the sound provided as a result of the processing in the active noise cancelling branch and the phase of the two sound signals must be of approximately opposite sign.

It is a specific advantage of the embodiment according to FIG. 5, that the total group delay reducing effect offered by the deconvolution filter provides flexibility with respect to choice of sample rate for the active noise cancelling branch, because the delay introduced by the change of sample rate may be at least partly compensated. Similarly, the total group delay reducing effect provides flexibility with respect to the choice of ADC and DAC type.

According to a variation of the FIG. 5 embodiment the amplitude response of the deconvolution filter 504 is determined based on a measurement of the direct transmission gain, (i.e. the attenuation of the sound transmitted past the in-the-ear part of the hearing aid system, when travelling from the ambient and to the ear drum). This measurement may be carried out during the initial programming of the hearing aid system, but may also be carried out at a later point in time in order to take various effects such as ageing of the hearing aid system components or repositioning of the in-the-ear part into account. The subsequent measurement may be carried out automatically with regular intervals or be user initiated. The latter option being particularly advantageous at least because it allows a convenient implementation where at least parts of the relative complex processing required to determine the direct transmission gain may be carried out in an external device, such as a smart phone, of the hearing aid system. Thus as will be obvious for a person skilled in the art the amplitude response of the deconvolution filter 504 is determined such that the amplitude response for the whole active noise cancelling branch matches the direct transmission gain.

In a specific variation the processing to be carried out in order to determine the direct transmission gain, may be offered as a software application (a so called app) that is downloadable to the external device or alternatively the functionality of the software application may instead be provided by a web service, that is hosted on an external server that may be accessed using a web browser of the external device.

The direct transmission gain may be determined by initially measuring an in-situ loop gain, subsequently selecting an effective vent parameter based on identification of a simulation model of the hearing aid system, which best approximates the measured in-situ loop gain, and finally determining the direct transmission gain using the simulation model with the selected effective vent parameter.

In an further variation the determined amplitude response of the deconvolution filter 504 takes the vent effect into account wherein the vent effect is defined as the sound pressure at the ear drum that is generated by the electrical-acoustical output transducer 508 in a sealed ear canal relative to the sound pressure at the ear drum that is generated by the electrical-acoustical output transducer 508 accommodated in the in-the-ear part having a given effective vent parameter.

Further details concerning how to determine an effective vent parameter and the related variables such as direct transmission gain and the vent effect may be found in U.S. Pat. No. 8,532,320B1.

In the following the in-the-ear part of the hearing aid system may also be denoted an ear plug.

According to a further variation the amplitude response or the total group delay of the deconvolution filter may be determined based on user interaction.

In yet further variations the active noise cancelling branch comprises a FIR filter in order to allow at least the total group delay and the amplitude response of the branch to be adjusted, in a simple manner, compared to designing the deconvolution filter to provide these adjustments. In a further variation the active noise cancelling branch comprises a broad band gain multiplier in order to allow the amplitude response of the branch to be adjusted, in a simple manner.

Therefore both the FIR filter and the broad band gain multiplier are especially advantageous when used to provide these adjustments in response to a user interaction.

In variations any filter capable of providing a desired amplitude response may be used instead of a FIR filter, such as an IIR filter.

In a variation the user interaction is controlled by an interactive personalization scheme, wherein a user is prompted to select between different settings of e.g. the total group delay and the amplitude response of the active noise cancelling branch, and based on the user responses the interactive personalization scheme finds an optimized setting. Further details on one example of such an interactive personalization scheme may be found e.g. in WO-A1-2016004983.

A method of optimizing settings of the active noise cancelling branch based on user preference through an interactive personalization scheme is particularly attractive because it is difficult to precisely simulate the impact from the active noise cancelling branch when the hearing aid system is worn by a user. Therefore effective active noise cancelling may be achieved even without using an ear canal microphone in order to optimize the settings of the active noise cancelling branch.

In other variations the deconvolution filter or the FIR filter is designed to provide a low pass filter characteristic, because the efficiency of the active noise cancelling may decrease with frequency, due to the higher sensitivity to misadjustments of the desired group delay in order to achieve cancelling and because the noise to be cancelled typically is low frequency noise. According to a more specific variation the deconvolution filter or the FIR filter is designed to provide a low pass filter characteristic with a cut-off frequency in the range between 1 kHz and 2 kHz. A further advantage of this variation is that an improved compromise may be found between the opposing objectives of respectively approximating the amplitude response to the desired target amplitude response and reducing the total group delay as much as possible.

As will be obvious for a person skilled in the art, the term "desired target amplitude response" is construed to reflect the desired target amplitude response for the whole active noise cancelling branch.

Generally, the combination of the deconvolution filter and an additional component such as a FIR filter or a broadband gain multiplier may be denoted a group delay reducing element.

In a variation the active noise cancelling branch is only activated in response to an effective vent size exceeding a threshold, whereby e.g. a hearing aid system capable of adjusting the effective vent size during use may become particularly interesting. However, in an alternative variation the hearing aid system programming software (which may also be denoted fitting software) is configured to only offer the active noise cancelling feature in case the selected vent provides an effective vent size that exceeds a predetermined threshold.

In another variation, the active noise cancelling branch is activated in response to a sound environment classification determining that the noise is primarily in the low frequency range and of a magnitude that makes it impossible to suppress the noise sufficiently even if the low frequency bands are shut down. This may be done simply by investigating if the sound pressure level at a given frequency is above a given threshold.

In further variations the methods and selected parts of the hearing aid according to the disclosed embodiments may also be implemented in systems and devices that are not hearing aid systems (i.e. they do not comprise means for compensating a hearing loss), but nevertheless comprise both acoustical-electrical input transducers and electro-acoustical output transducers. Such systems and devices are at present often referred to as hearables. However, a headset is another example of such a system.

In still other variations a non-transitory computer readable medium carrying instructions which, when executed by a computer, cause the methods of the disclosed embodiments to be performed.

Other modifications and variations of the structures and procedures will be evident to those skilled in the art.

The invention claimed is:

1. A hearing aid system comprising:

a main signal path branch and an active noise cancelling branch, wherein the branches share an acoustical-electrical input transducer, an analog-digital converter, a digital-analog converter, an electrical-acoustical output transducer, a signal splitter configured to branch a signal in the main signal path into the active noise cancelling branch and a signal combiner to add the signals from the two branches;

wherein the main signal branch further comprises a digital signal processor configured to apply a frequency dependent gain that is adapted to at least one of suppressing noise and alleviating a hearing deficit of an individual wearing the hearing aid system; and wherein the active noise cancelling branch comprises a group delay reducing element; and wherein the group delay reducing element comprises a deconvolution filter configured to have a transfer function that is the inverse of a minimum phase part of a combined transfer function of at least one hearing aid component selected from a group consisting of the acoustical-electrical input transducer, the analog-digital converter, the digital-analog converter and the electrical-acoustical output transducer.

2. The hearing aid system according to claim 1, wherein the group delay reducing element comprises a time-varying filter.

3. The hearing aid system according to claim 1, wherein the group delay reducing element is configured to provide at least one of an amplitude response and a group delay that is determined based on at least one of a determined direct transmission gain and a user interaction.

4. The hearing aid system according to claim 3, wherein the direct transmission gain is determined by initially measuring an in-situ loop gain, subsequently selecting an effective vent parameter based on identification of a simulation model of the hearing aid system, which best approximates the measured in-situ loop gain, and finally determining the direct transmission gain using the simulation model with the selected effective vent parameter.

5. The hearing aid system according to claim 3, wherein the amplitude response provided by the group delay reducing element takes the vent effect into account, wherein the vent effect is defined as the sound pressure at the ear drum that is generated by the electrical-acoustical output transducer in a sealed ear canal relative to the sound pressure at the ear drum that is generated by the electrical-acoustical output transducer accommodated in an ear plug with a given effective vent parameter.

6. The hearing aid system according to claim 3, wherein the user interaction is configured to allow the individual wearing the hearing aid system to identify a preferred setting by varying at least one of the amplitude response and the group delay of the group delay reducing element.

7. The hearing aid system according to claim 1, wherein the group delay reducing element provides an amplitude response with a low pass filter characteristic.

8. A method of operating a hearing aid system comprising the steps of:

obtaining a combined transfer function of at least one hearing aid component selected from a group consisting of an acoustical-electrical input transducer, an analog-digital converter, a digital-analog converter and an electrical-acoustical output transducer;

decomposing the combined transfer function into a first minimum phase transfer function and a first all-pass transfer function;

providing a deconvolution filter transfer function as the inverse of the first minimum phase transfer function;

processing a received sound in a main signal path of the hearing aid system in order to provide at least one of suppressing noise and alleviating a hearing deficit of an individual wearing the hearing aid system;

processing the received sound in an active noise cancelling signal path in order to provide a low delay signal by filtering it with a filter having the deconvolution filter transfer function;

combining the main signal path and the active noise cancelling signal path, by subtracting the signal provided by the active noise cancelling signal path from the signal provided by the main signal path and hereby providing a combined signal to the electrical-acoustical output transducer.

9. A method according to claim 8, comprising the step of: controlling at least one of an amplitude response and a group delay of the active noise cancelling signal part based on a user interaction.

10. A non-transitory computer readable medium carrying instructions which, when executed by a computer, cause the following method to be performed:

obtaining a combined transfer function of at least one audio component selected from a group consisting of an acoustical-electrical input transducer, an analog-digital converter, a digital-analog converter and an electrical-acoustical output transducer;

decomposing the combined transfer function into a first minimum phase transfer function and a first all-pass transfer function;

providing a deconvolution filter transfer function as the inverse of the first minimum phase transfer function;

processing a received sound in a main signal path in order to provide at least one of suppressing noise and alleviating a hearing deficit of an individual;

processing the received sound in an active noise cancelling signal path in order to provide a low delay signal by filtering it with the deconvolution filter transfer function;

combining the main signal path and the active noise cancelling signal path, by subtracting the signal provided by the active noise cancelling signal path from the signal provided by the main signal path and hereby providing a combined signal to the electrical-acoustical output transducer.

* * * * *